US006362424B1

(12) United States Patent
Honkomp et al.

(10) Patent No.: US 6,362,424 B1
(45) **Date of Patent: *Mar. 26, 2002**

(54) HERMETIC TERMINAL RETAINER STRUCTURE

(75) Inventors: Glenn A. Honkomp, Loveland; Tariq Quadir, West Chester; Stephanie S. Chapman, Cincinnati, all of OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/583,436

(22) Filed: May 31, 2000

Related U.S. Application Data

(63) Continuation of application No. 09/188,161, filed on Nov. 7, 1998, now Pat. No. 6,107,566.

(51) Int. Cl.[7] ..... H01J 15/00

(52) U.S. Cl. ..... 174/50.52; 174/50.63; 174/50.59; 174/152 GM; 439/935

(58) Field of Search ..... 174/50.61, 50.52, 174/50.63, 152 GM, 50.59; 439/935, 926, 282, 685

(56) References Cited

U.S. PATENT DOCUMENTS

| | | | | |
|---|---|---|---|---|
| 2,517,023 A | | 8/1950 | Prakke | |
| 3,721,948 A | | 3/1973 | Brandt et al. | |
| 4,103,416 A | | 8/1978 | Sakamoto | |
| 4,296,275 A | * | 10/1981 | Bowsky | 174/152 GM |
| 4,461,925 A | | 7/1984 | Bowsky et al. | |
| 4,580,003 A | | 4/1986 | Bowsky et al. | 174/152 GM |
| 4,584,333 A | | 4/1986 | Bowsky et al. | 174/152 GM |
| 4,584,433 A | | 4/1986 | Bowsky et al. | |
| 4,984,973 A | | 1/1991 | Itameci-Kinter et al. | |
| 5,117,089 A | * | 5/1992 | Honkomp et al. | 219/201 |
| 5,471,015 A | | 11/1995 | Paterek et al. | 174/152 GM |
| 5,493,073 A | * | 2/1996 | Honkomp | 174/152 GM |
| 5,584,716 A | * | 12/1996 | Bergman | 439/282 |
| 5,675,122 A | | 10/1997 | Taylor | |
| 5,703,326 A | | 12/1997 | Yamada et al. | |
| 5,736,675 A | | 4/1998 | Michaels | |
| 6,107,566 A | * | 8/2000 | Quadir et al. | |

* cited by examiner

*Primary Examiner*—Anthony Dinkins
*Assistant Examiner*—Dhiru R Patel
(74) *Attorney, Agent, or Firm*—Harness, Dickey & Pierce, P.L.C.

(57) ABSTRACT

A hermetic terminal assembly including a body member with a bottom portion and a surrounding boundary or flange portion with at least one current conducting pin sealed in an opening in the bottom portion and an over-surface stratum or disk disposed in close fit relation in said body member in facing relation with said bottom and flange portions and having disk retention means therefore, and preselectively sized and positioned fuse-like burn-off apertures in the current conducting pin to interrupt current conductivity at selected times, temperatures and amperage density.

31 Claims, 3 Drawing Sheets

HERMETIC TERMINAL RETAINER STRUCTURE

CROSS-REFERENCE TO RELATED APPLICATION

This application is a continuation-in-part of U.S. Pat. application Ser. No. 09/188,161 filed on Nov. 7, 1998, now U.S. Pat. No. 6,107,566, the disclosure of which is incorporated herein by reference.

BACKGROUND OF THE INVENTION

The present invention relates to hermetic terminal structural assemblies and more particularly to retainer structure for hermetic terminal assemblies which maximizes over-surface distances and protects glass surrounding pins.

In the hermetic terminal assembly art, a number of construction arrangements have been utilized to prevent conductive pins, which pins serve to conduct current to isolated drive sources such as drive motors, disposed in hermetically sealed compressor housing shells, from electrically shorting to surrounding electrically conductive areas such as the aforementioned housing shells of compressors. These past arrangements have included surrounding conductive pins with insulated over-surface collars or sleeves, such as the insulating extended sleeve arrangement 23 disclosed in U.S. Pat. No. 4,584,433, issued to B. Bowsky, et al. on Apr. 22, 1986 and the sleeve arrangement 17 disclosed in U.S. Pat. No. 5,471,015, issued to F. Dieter Paterek, et al. On Nov. 28, 1995. These two aforementioned patents were further concerned with conductive pin fusing and with pin design, respectively, attention being particularly directed to the aperture 36 in U.S. Pat. No. 4,580,003, issued to B. Bowsky et al. on Apr. 1, 1986 and to aperture 38 of flattened neck portion 37 of pin 17 above in U.S. Pat. No. 4,584,333, issued to B. Bowsky et. al. on Apr. 22, 1986, and to the relative coefficients of expansion and softening point temperatures in U.S. Pat. No. 5,471,015, issued to F. D. Paterek et. al. on Nov. 28, 1995.

In the present invention, an insulated disk member of select material provides the desirable over-surface construction, this disk member being held in fast position through a unique retention arrangement cooperative with the pin construction. In combination with the novel over-surface disk member, the present invention provides a unique, readily regulatable fuse-like pin construction. Like the co-pending application, Ser. No. 09/188,161, filed 11/07/98, applicants Tariq Quadir, et al, the novel arrangement set forth herein also is straightforward and economical in manufacture, assembly and maintenance, requiring a minimum of operating steps and parts in manufacture, assembly and maintenance.

Various other features of the present invention will become obvious to one skilled in the art upon reading the disclosure set forth herein.

BRIEF SUMMARY OF THE INVENTION

More particularly the present invention provides a unique hermetic terminal assembly comprising: a body member including a generally flat bottom portion and a boundary or flange portion extending along the periphery of the bottom portion, the bottom portion having at least one opening therein; a current conducting pin extending through the bottom portion opening; a stratum of insulating material in close proximity fit to the bottom and boundary portions of the body member, the stratum of insulating material having at least one opening corresponding with the opening of said bottom portion of the body member with the current conducting pin also extending therethrough; insulating pin sealing means extending between and sealing the periphery of said current conducting pin to the periphery of the opening in the bottom portion; and stratum restraining means cooperative with the insulating pin sealing means to restrain the stratum in fast close fit position with respect to the bottom and the boundary portions of the body member.

In addition, the present invention provides for a novel current conductive pin with readily regulatable fuse-like properties, the pin having a preselected length and a preselected cross-sectional area with at least one fuse-like aperture disposed in the pin along the longitudinal axis of the pin a preselected distance from one extremity of the pin, the fuse-like aperture being of a preselected cross-sectional area preselectively dependent upon the geometry of the pin to provide at least one area adjacent the aperture of electrically conductive material, the adjacent area being sized and measured to burn off in fuse-like fashion at a controlled amperage density with one end of the pin adapted to be connected to an electrical supply source and the opposite end to an electrically dependent apparatus.

It is to be understood that various changes can be made by one skilled in the art in one or more of the several parts of the novel structural assembly disclosed herein without departing from the scope or spirit of the present invention.

BRIEF DESCRIPTION OF THE DRAWINGS

Referring to the drawings, which disclose advantageous embodiments of the present invention.

DETAILED DESCRIPTION OF THE INVENTION

Figure 2:
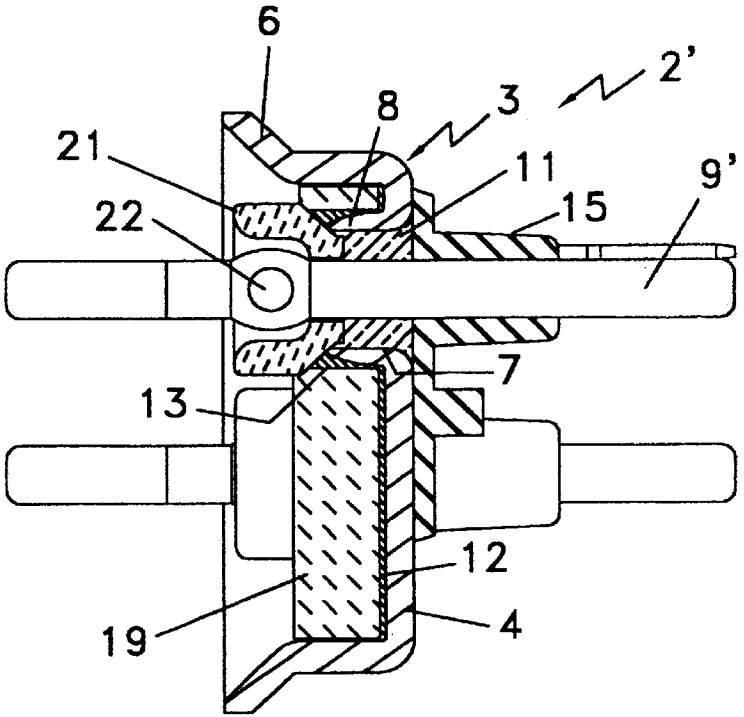
FIG. 2 is a schematic, cross-sectional view of another terminal assembly similar to that of FIG. 1 and incorporating an inventive fuse-like apertured pin in place of the conductive pin of FIGS. 1 and 2 and a different stratum arrangement.
Figure 1:
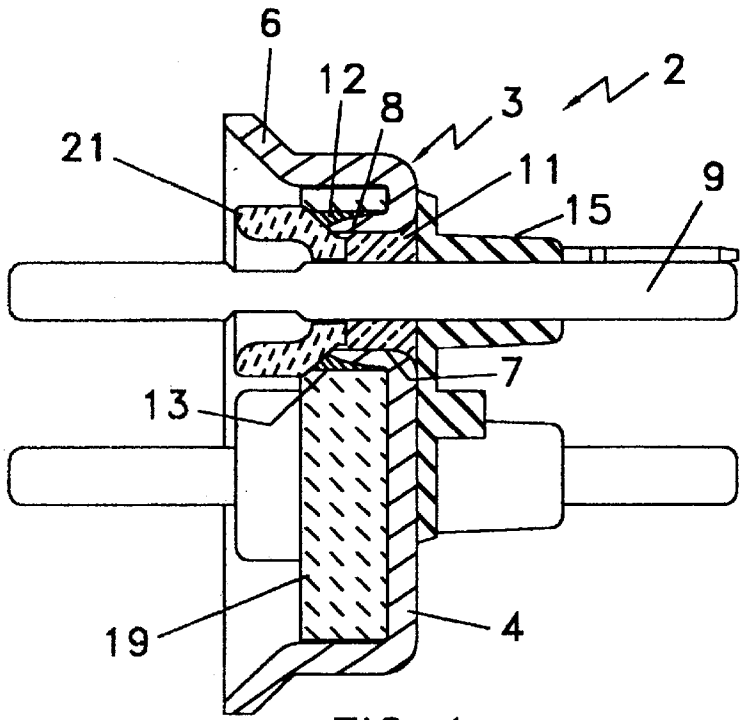
FIG. 1 is a schematic, cross-sectional view of a hermetic terminal assembly incorporating one embodiment of the unique and novel retention structure.

As can be seen in FIGS. 1 and 2 of the drawings, the hermetic terminal assemblies 2 and 2' each includes a metallic cup-shaped body member 3 which is of a preselected configuration and which is formed from cold rolled steel material—all as is generally well known in the art. Cup-shaped body member 3 includes a generally flat bottom portion 4 and a boundary portion 6, here disclosed in the form of an integral flange or sidewall extending along and outwardly from the periphery of bottom portion 4 to surround the inner face of bottom portion 4. As also is known in the art, bottom portion 4 is provided with three substantially equally spaced and equally sized openings 7 (only one of which can be seen in the terminal assemblies 2 and 2' (FIGS. 1 and 2). Each opening 7 is defined by an interior wall surface of annular lip 8, which lip is an integral part of cup-shaped body member 3 and which extends outwardly from the inner face of bottom portion 4 to be within boundary or flange 6 of body member 3. A suitable electric current conductive pin 9 (FIG. 1) and 9' (FIG. 2) extends through each opening 7 with the peripheral, circumferential surface of each pin 9 (FIG. 1) and 9' (FIG. 2) being spaced in relation to the interior wall surface of annular lip 8 and each opening 7. A suitable insulating arrangement 15 made from an appropriate insulating material, such as rubber, is provided along conductive pins 9 and 9' extending from an outer face of each cup-shaped body member 4 and surrounding a portion of each pin 9 and 9'.

An insulating glass seal 11 extends between the circumferential periphery of each pin 9 (FIG. 1) and 9' (FIG. 2) and the wall of the respective opening 7 and the interior wall surface of annular lip 8 to seal the pin 9 and 9' respectively in its body member 3 so as to be in insulated relation with the body member 3.

In accordance with one novel feature of the present invention as disclosed in different arrangements in FIGS. 1 and 2, an extended over-surface stratum or layer 12 (FIG. 2) of suitable insulating material such as ceramics—glass is provided. Stratum 12 can be of varying thickness, depending upon the environmental conditions involved, so as to be appropriately sized and configured in either wafer or disk form. The stratum 12 can include three openings 13, each opening correspondingly aligned with one of the openings 7 in the bottom portion 4 of body member 3 (only one such opening being disclosed in FIGS. 1 and 2 of the drawings). In this regard, it is to be noted that each stratum opening 13 is not only positioned to be correspondingly aligned with an opening 7 in the bottom portion 4 of cup-shaped body member 3, but the stratum opening 13 is further sized to engage in close fit proximate relationship with the outer periphery of annular lip 8. It also is to be noted that in FIG. 1, stratum 12 is disclosed only as a ring around each annular lip 8, it being understood that a bottom portion to face bottom portion 4 can be designed to be extremely thin or even eliminated with a suitable insulating adhesive being substituted therefor if desired. It is to be understood that in other unique and novel embodiments of the present invention, insulating stratums 12 and 13 as disclosed in FIG. 1 and 2 and as described above can be eliminated and other insulating materials such as a hard, strong, resistant adhesive, like an epoxy or a polymeric resin can be utilized as disclosed in FIG. 6 and 7—as described hereinafter.

In the inventive embodiments of FIGS. 1 and 2, a novel, over-surface disk 19 of non-porous ceramic insulating material is disclosed as engaging the inner face of bottom portion 4 of cup 3 (FIG. 1) or the bottom face of stratum 12 (FIG. 2) as well as the inner face of boundary or flange portion 6 of cup-shaped body member 3 so as to be in close fit proximate relationship with these body member portions. As above discussed, bottom portion 4 of FIG. 1 is provided with openings 7 (only one shown), each opening 7 including associated integral annular lip 8, current conducting pin 9 and glass seal 11. In the inventive disclosure of FIGS. 1 and 2 herein, the hermetic terminal assembly does not employ liquid epoxy adhesives or crowns to maintain the stratums 12 and 13 or ceramic disk 19 with its corresponding openings in close fit proximate relationship to cup-shaped body member 3, as described in the above mentioned co-pending patent application. To accomplish over-surface ceramic disk retention in the embodiments of FIGS. 1 and 2, tapered insulated collars or sleeves 21 which also can be of a suitable non-porous insulating ceramic material can be provided to surround and accommodate passage therethrough of current conducting pins 9 (only one shown). Each insulating collar 21, as can be seen in FIGS. 1 and 2, has one end sealed in fast relation to the insulating glass seal 11 and the opposite collar end extending beyond the periphery of ceramic disk 19 opening 13 (correspondingly aligned with opening 7 of bottom portion), the outwardly extending neck portion of such opposite end abuttingly engaging the surrounding surface of the opening in disk 19). Thus, the ceramic disk 19 is held in fast position without the aforedescribed crowns and epoxy or polymeric resins as hereinafter described for the novel arrangements of FIGS. 6 and 7. It is to be understood that in this embodiment of the invention, the close fit relation between disk 19 and the body portion 4 and 6 of body member 3 can be enhanced by fine-sizing and with knurling at selected areas if indicated, along with an appropriate press fitting if desired and with the use of appropriate sealing materials wherever required.

It further is to be understood that for hermetic terminal assemblies such as disclosed, the non-porous ceramic disk 19 (of both FIGS. 1 and 2 and FIGS. 6 and 7) which inhibits deposition of electrically shorting materials can be of a thickness in the range of approximately zero point one five (0.15) to zero point two zero (0.20) inches and advantageously of approximately zero point one eight (0.18) inches. In addition, in keeping with the ceramic disk retention concept of the present invention, the disk 19 can be retained in position by an extension of glass seal 11 into sealing relation with the peripheral wall of ceramic disk opening 13 or by incorporating a collar-like extension portion on ceramic disk 19 which can engage annular lip 8 in sealed relation with glass seal 11. In either of these instances, the insulating collar 21, as shown, would be eliminated. Further, it is to be understood that ceramic disk 19 and the disclosed ceramic sleeve 21 can be covered with a suitable thermal spray coating to provide a further protective insulating surface. Such a thermal spray coating can incorporate one or more suitable materials such as $Al_2O_3$, Ytria stabilized zirconia (YTZP), Forsterite or Steatite or monolithic disk material such as $Si_3N_4$, ALN, or $ZrO_2$.

Figure 3:
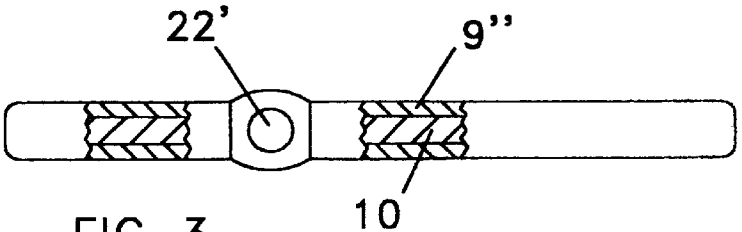
FIG. 3 is a schematic, partially broken-away cross-sectional plan view of an apertured conductive pin formed with a differing core metal, which pin can be employed with the terminal assembly of FIGS. 1 and 2 instead of those disclosed.

Referring specifically to FIGS. 2 and 3 of the drawings, apertured conductive pins 9' (FIG. 2) and 9" (FIG. 3) are disclosed. These pins have a preselected length and a preselected cross-sectional area with the conductive pins associated with hermetic terminal assemblies such as those described above having a length of approximately one and seven eighths (1 ⅞) inches and an overall diameter of approximately zero point one two five (0.125) inches. The pins 9 and 9', as disclosed in FIGS. 1 and 2, can be formed completely from an electrically conductive alloyed metal such as stainless steel or can include a different core metal 10 of a lower melting point, such as copper, as disclosed for pin 9" in FIG. 3. As can be seen in FIGS. 2 and 3 of the drawings, fuse-like apertures 22 and 22' in pins 9' and 9" respectively are disclosed. These apertures 22 (FIG. 2) and 22' (FIG. 3) are provided with a smooth peripheral surface to avoid premature burn-off and are disposed along the longitudinal axis of pins 9' and 9" respectively to be a carefully regulated preselected distance from one extremity of the pin, depending upon the nature of the use of the pin.

In accordance with one feature of the present invention, each of the regulated apertures is of a preselected cross-sectional area and geometry. Here, the apertures are disclosed as substantially circular in form but it is to be understood that other shapes, such as, but not limited to, rectangular or slit-like. Significantly, the regulated aperture should provide at least one area adjacent thereto and preferably extending to the pin periphery sized to burn-off in controlled fuse-like fashion at a preselected and predetermined time, temperature and amperage density so as to positively interrupt current flow through the pin with which it is associated at a controlled stage.

Although this novel fuse-like regulated pin aperture is herein disclosed in combination with the novel ceramic disk arrangement for an hermetic terminal assembly, it is to be understood that such novel apertured pin can be successfully utilized in other electrical assemblies where controlled fuse-like qualities are desired.

Figure 4:
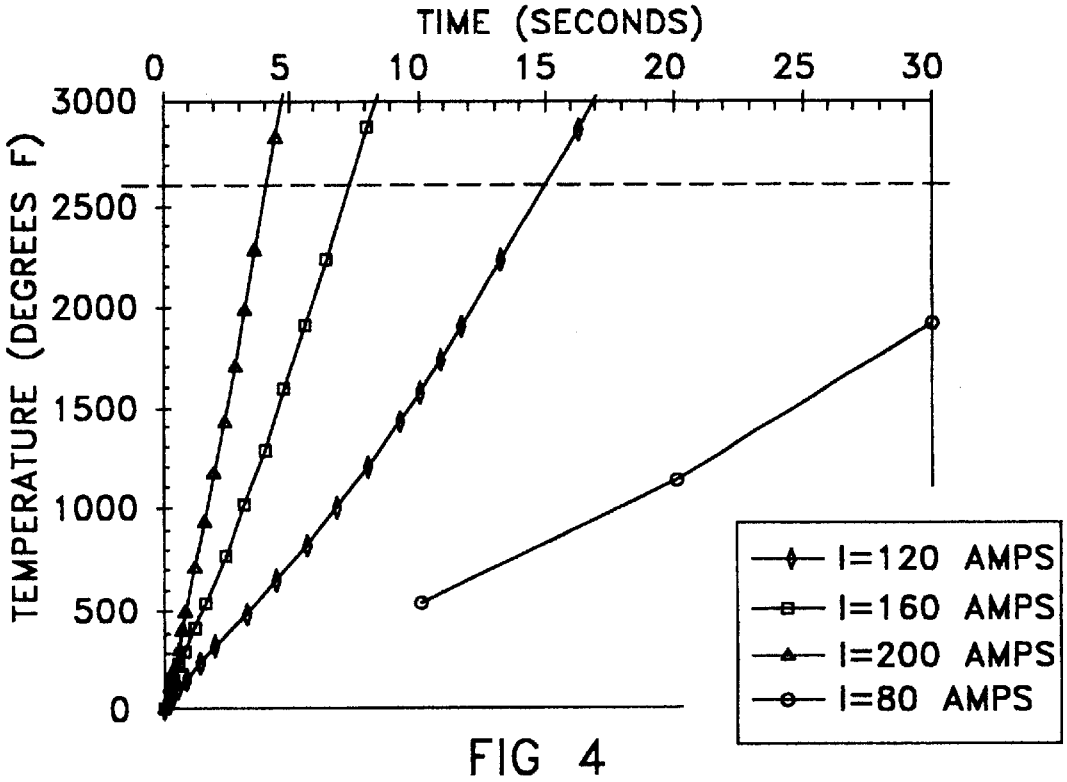
FIG. 4 is a conductive solid pin graph that illustrates varying current densities as a function of pin burn-off time.
Figure 5:
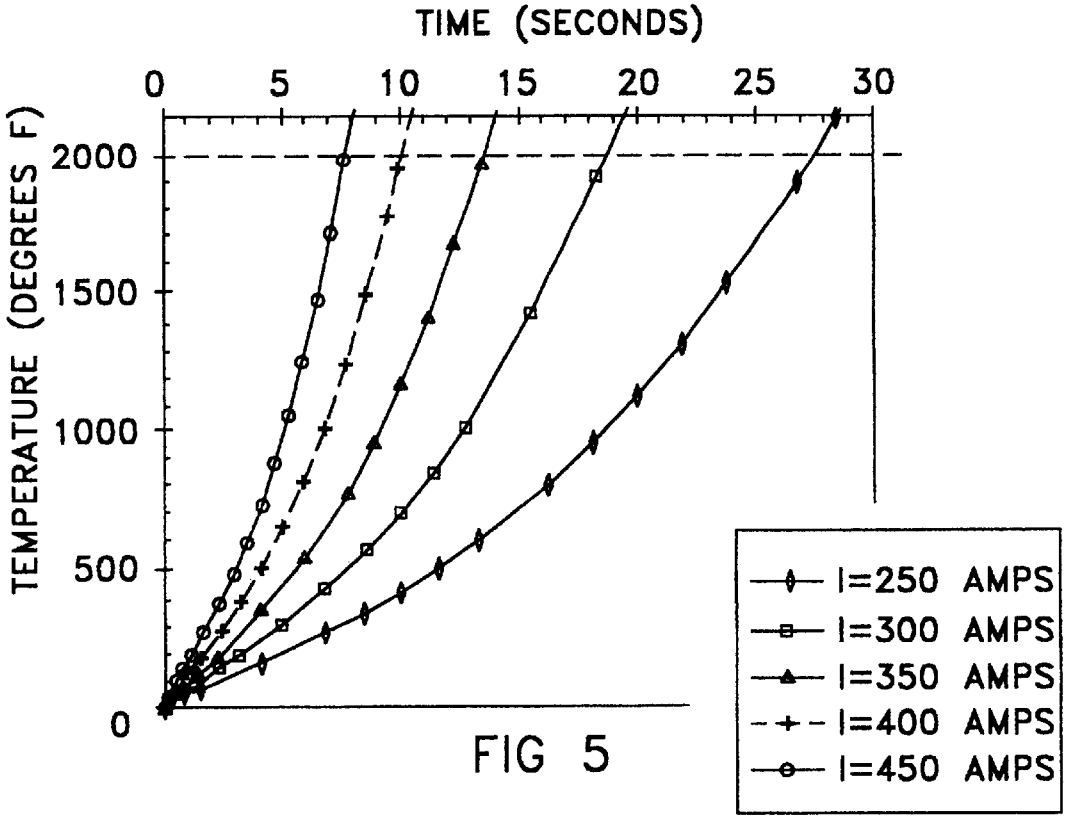
FIG. 5 illustrates the same concept as FIG. 4 except for a pin with a copper core.
Figure 6:
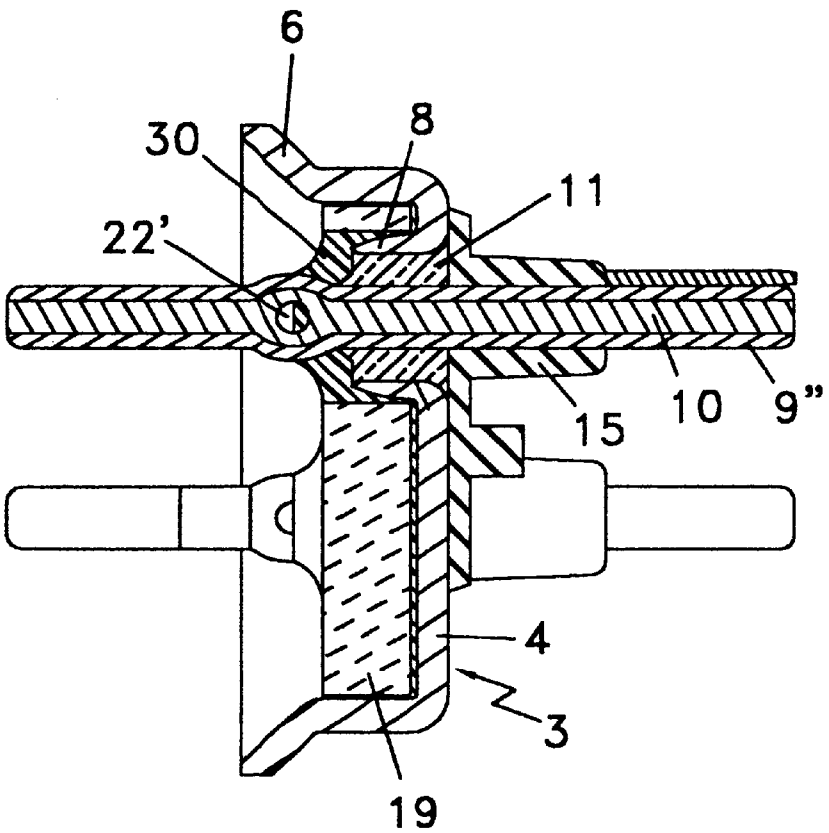
FIG. 6 is a further schematic, cross-sectional view of a hermetic terminal assembly also similar to FIG. 1, disclosing a pin formed with a differing core metal such as in FIG. 3 and substituting an epoxy material for the ceramic collar surrounding a conductive pin within a boundary portion of a cup shaped body member; and, FIG. 7, is still a further schematic, cross-sectional view of a hermetic terminal, also similar to FIGS. 1 and 6, substituting an epoxy material surrounding a conductive pin both within a boundary portion of a cup shaped body member as in FIG. 6 and in place of a pin insulator, such as rubber (FIG. 6) along a portion of a conductive pin extending from an outer face of a cup shaped body member.

Referring to FIG. 4, an inventive graph is disclosed for stainless steel pins of an overall diameter of approximately zero point one two five (0.125) inches, these pins being advantageously designed for incorporation with the inventive hermetic terminal assembly oversurface ceramic disk arrangement such as disclosed in FIGS. 1–3 and 6–7 of the drawings. The graph of FIG. 4 is for pins which are substantially circular throughout, except for the portion of aperture location, the outer diameter of the pin where the pin is circular being approximately zero point one two five (0.125) inches. The cross-sectional area of a solid pin in the graph of FIG. 4 is approximately zero point zero zero four four (0.0044) square inches. The cross sectional area of the substantially circular aperture of a copper core pin in the graph of FIG. 5 is approximately point zero zero five three two (0.00532) square inches with the outer circular pin diameter also being zero point one two five (0.125) inches and the circular core diameter being approximately zero point zero six two five (0.0625) inches except for the portion of aperture location. The four amperage curves in FIGS. 4 and 5 plotting temperature in degrees Fahrenheit (vertical line) relative time in seconds (horizontal line) are represented by identical symbols. An open diamond symbol represents an amperage of one hundred and twenty (120) amps; an open rectangular symbol represents an amperage of one hundred and sixty (160) amps; an open triangular symbol represents and amperage of two hundred (200) amps; and, an open circle symbol represents an amperage of eighty (80) amps. In FIG. 5, also plotting temperature against time in the same increments as FIG. 4, the open diamond symbol represents an amperage of two hundred fifty (250) amps; the open rectangular symbol represents three hundred (300) amps; the open triangle symbol represents an amperage of three hundred fifty (350) amps; the plus symbol represents an amperage of four hundred (400) amps; and, the open circular symbol represents an amperage of four hundred fifty (450) amps. The melt or burn-off line 25, where current flow through the pin ceases, is represented by a horizontal dash line in the two graphs. A review of the three graphs indicates, among other factors, that burn-off time is less with higher amperages and that larger apertures result in less burn-off material remaining with concomitant shorter burn-off time. Further, and as can be seen in FIG. 6, representing a copper core pin, the burn-off is lowered with increased amperages with the highest amperage remaining within a desired time limit. As a general rule, for the inventive structure, disclosed burn-off should occur in an annular burn-off area extending between aperture and pin periphery with temperatures in degrees Fahrenheit between approximately two five seven seven (2577) degrees Fahrenheit and approximately two six one seven (2617) degrees Fahrenheit; within a first time range of approximately one zero (10) to two five (25) seconds to a second time range of approximately one seven (17) to approximately four five (45) seconds; and, at amperages in the first range of approximately three seven five (375) to one six zero (160) amps to a second range of four one zero (410) to one nine zero (190 amps. Advantageously, for the hermetic assembly structure disclosed, the temperature should be approximately two five nine seven (2597) degrees Fahrenheit, within one four (14) to three six (36) seconds and at four zero zero (400) to one seven five (175) amps.

Figure 7:
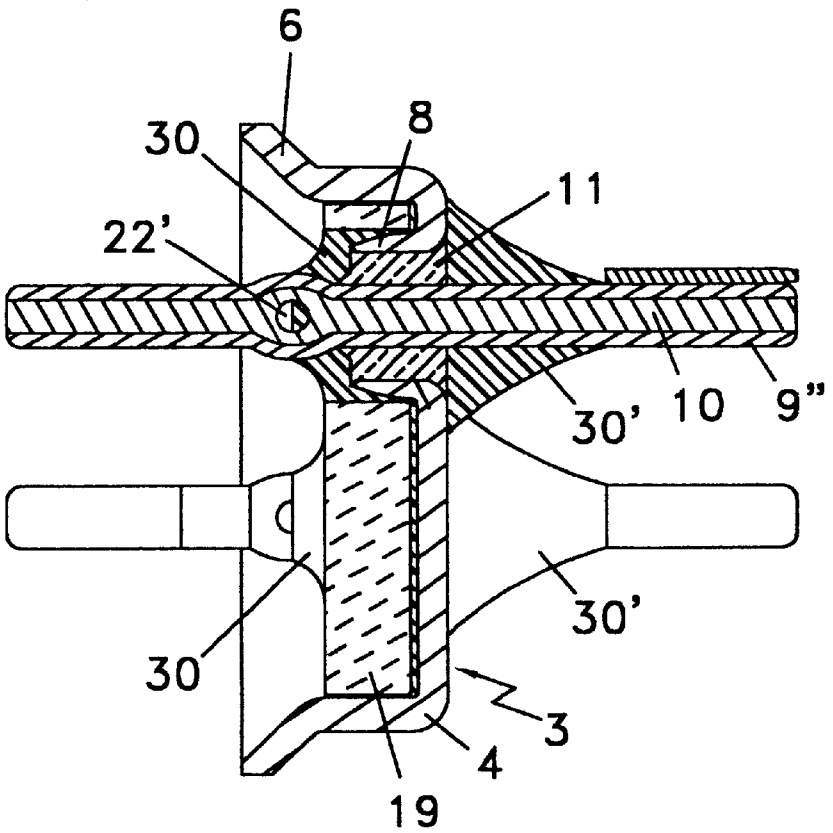

In FIGS. 6 and 7, metallic core pins 9", such as disclosed in FIG. 3 of the drawings, are shown extending respectively through cup-shaped body members 3 and sealed thereto in a manner similar to the arrangements of FIGS. 1 and 2, each arrangement of these two FIGS. 6 and 7 including the novel ceramic disk 19 with both arrangements not incorporating stratum arrangements 12 and 13 as shown in FIGS. 1 and 2. Instead, in FIG. 6, a hard, strong, resistant adhesive coating 30, such as suitable polymeric or epoxy resin, is disclosed within boundary 6 of cup-shaped body member 3 sealingly abutting and fastened between the outer face of lip 8 and the inner face of an aperture in ceramic disk 19 which accommodates passage of pin 9" there through. Coating 30 further adheres to and covers the inner face of glass seal and adheres to a portion of the outer perimeter of conductive pin 9" extending through an appropriate aperture in cup-shaped body member 3. A similar novel sealing arrangement can be seen in FIG. 7 of the drawings along the inner face of cup-shaped body member 3. However, in the arrangement of FIG. 7, in place of the rubber insulating arrangement 15 extending from the outer face of cup-shaped body member to surround each pin, an outer adhesive epoxy coating 30', like the material of inner coating 30 can be provided in place of the rubber insulating arrangement 15. It is to be understood that other conductive pins, besides the core pins 9" such as shown in FIGS. 6 and 7 can be employed with the novel arrangements of FIGS. 6 and 7. Further, it is to be understood that in place of the epoxy coating 30 and 30' disclosed in FIGS. 6 and 7, it would be possible to employ a collar or sleeve made of an electrically insulating thermoset epoxy powder which, after heating is applied, melts and cures to harden in fast relation to glass seal 11, current conducting pin 9' or 9" and ceramic disk 19 to hold disk 19 in fast position. Further, a two-part liquid, electrically insulating thermoset epoxy resin can be employed which, after heating, will cross-link to cure and harden in similar, fast relation to glass seal 11, pin 9' or 9", and ceramic disk 19.

The invention claimed is:

1. A hermetic terminal assembly comprising: a metallic body member including a generally flat bottom portion having an inner face and a boundary portion having inner and outer faces extending along the periphery of said bottom portion, said bottom portion having at least one opening there through; a current conducting pin longitudinally extending through said opening; a disk of non-porous insulating material facing said inner faces of said bottom and said boundary portions of said body member, said disk of insulating material having at least one opening there through, with a disk opening periphery corresponding with said opening of said bottom portion of said body member and with said current conducting pin also extending there through; insulating pin sealing means extending at least between and sealing the periphery of said current conducting pin to the periphery of said opening in said bottom portion; and insulating disk retention means to maintain said disk in close fit proximate position with respect to said inner faces of said bottom and said boundary portions of said body member.

2. The hermetic terminal assembly of claim 1, said insulating disk retention means to hold said disk in close fit proximate facing position with respect to said bottom and said boundary portions of said body member comprising an insulating retention stratum which extends in fast relation between said insulating pin sealing means and said disk of insulating material.

3. The hermetic terminal assembly of claim 1, said insulating disk retention means to maintain said disk in close fit proximate facing position with respect to said inner faces of said bottom and said boundary portions including an insulated collar member surrounding the periphery of said current conducting pin with one end of said collar member sealed to said pin sealing means which seals said pin to the periphery of said opening in said bottom portion of said body member and the other end thereof extending outwardly beyond said periphery of said bottom opening and sealingly abutting said periphery of an adjacent disk opening.

4. The hermetic terminal assembly of claim 1, said insulating disk retention means comprising an epoxy resin adhesive coating surrounding and fastened between said pin and said pin sealing means which seals said pin to the periphery of said opening in said bottom portion of said body member and said periphery of an adjacent disk opening.

5. The hermetic terminal assembly of claim 4, said epoxy resin adhesive coating surrounding and fastened to said pin in sealing relation along the inner face and an outer face of said bottom portion of said body member.

6. The hermetic terminal assembly of claim 1, at least one of said close fit proximate facing surfaces of said disk of insulating material and said body member portions including retaining ridges.

7. The hermetic terminal assembly of claim 1, said body member being cup-shaped to include said bottom portion in flat configuration with said boundary portion being in the form of an outwardly extending flange to form said boundary portion.

8. The hermetic terminal assembly of claim 1, said insulating pin sealing means being glass.

9. The hermetic terminal assembly of claim 1, said opening in said body portion including an annular lip with said insulating pin sealing means extending between the periphery of said conducting pin and said annular lip.

10. The hermetic terminal assembly of claim 1, said disk being of a non-porous ceramic material to prevent retention of electrical shorting particulate materials.

11. The hermetic terminal assembly of claim 1, said disk of insulating material facing said bottom portion of said body member having a suitable coating of insulative material.

12. The hermetic terminal assembly of claim 1, said bottom portion and said disk of insulating material including three corresponding pairs of spaced openings, and, three spaced current conducting pins passing respectively there through.

13. The hermetic terminal assembly of claim 1, said insulating disk having a thickness in the proximate range of zero point one five (0.15) to zero point two zero (0.20) inches.

14. The hermetic terminal assembly of claim 1, said insulating disk having a thickness advantageously of zero point one eight (0.18) inches.

15. The hermetic terminal assembly of claim 1, and an extended, insulating stratum of preselected material positioned between said insulating disk and the bottom portion of said metallic body member.

16. The hermetic terminal assembly of claim 1, said current conducting pin formed from at least one fuse-like aperture disposed in said pin along the longitudinal axis of said pin a preselected distance from one extremity of said pin, said fuse-like aperture being of a preselected cross-sectional area preselectively dependent upon the geometry of said pin to provide at least one area adjacent said aperture, said adjacent area being sized to burn-off in fuse-like fashion at a preselected time, temperature and amperage density to interrupt current conductivity of said pin.

17. The hermetic terminal assembly of claim 16, said current conducting pin being formed from stainless steel along the longitudinally extending outer portion thereof and having an inner core of copper.

18. The hermetic terminal assembly of claim 16, wherein said adjacent area is annular and extends to said pin periphery and burn-off occurs with temperatures in degrees Fahrenheit in the range of approximately two five seven seven (2577) to two six one seven (2617) degrees, in a first time range of approximately one zero (10) to approximately two five (25) to a second time range of approximately one seven (17) four five (45) seconds and at amperages in the range of approximately one six zero (160) to one nine zero (190) amps.

19. The hermetic terminal assembly of claim 16, wherein said adjacent area is of annular nature to extend between said aperture and said pin periphery with burn-off occurring advantageously with a temperature of two five nine seven (2597) degrees Fahrenheit, a time range of approximately one four (14) to three six (36) seconds, and an amperage of approximately one seven five (175) amps.

20. The hermetic terminal assembly of claim 16, said current conducting pin being of cylindrical cross-section to include a copper core and an outer body portion with said outer diameter of said pin being approximately zero point one two five (0.125) inches, said inner core diameter being approximately point zero six two five (0.0625) inches.

21. The current conducting in of claim 1, wherein said fuse-like aperture is provided with a smooth peripheral surface free of protrusions to reduce premature possible burning areas.

22. A hermetic terminal assembly comprising: a metallic cup-shaped body member including a generally flat bottom portion and a boundary portion, each portion including inner and outer faces with said boundary portion being in the form of an integral flange extending along and outwardly from the periphery of said bottom portion to surround the inner face of said bottom portion, said bottom portion having multiple, substantially equally spaced and equally sized openings therein with each of said openings having an outwardly extending annular lip extending along the periphery thereof in surrounding relation therewith and outwardly from said inner face of said bottom portion; a current conducting pin extending through each of said multiple openings with the peripheral surface of each pin in spaced relation to the periphery of said opening and the inner periphery of said outwardly extending surrounding annular lip; insulating glass seals extending between the periphery of each of said pins and said respective inner periphery of said opening and inner annular lip perimeters to seal said pin in said opening;

an insulated disk of non-porous ceramic material having multiple openings, each corresponding with one of the openings in said bottom portion of said cup-shaped bottom member, said insulating disk including preselectively knurled surfaces sized and contoured to face in close fit proximity to said bottom inner face and said inner face of said flange portions, disk retention means sealingly cooperative with said insulating glass seals to maintain said disk in close fit proximate position with respect to said inner faces of said bottom and flange portions, said annular lips adjacent said corresponding openings and said boundary portion flange.

23. The hermetic terminal assembly of claim 22, said disk retention means including tapered insulated collar members, each surrounding the periphery of said current conducting pins, each collar having one end sealed to said insulating glass seals and the opposite end extending beyond the periphery of said disk opening and abuttingly sealed adjacent thereto.

24. The hermetic terminal assembly of claim 22, each current conducting pin having a fuse-like aperture disposed therein of preselected cross-sectional area to provide a burn-off area in said pin adjacent said aperture, said adjacent burn-off area being sized to burn-off in fuse-like fashion at a preselected time, temperature and amperage density to interrupt current conductivity of said pin.

25. In an electrical circuit wherein electrical current is to be conducted from an electrical supply source to apparatus depending upon such electrical current, an improved current conducting pin with fuse-like properties comprising: a longitudinally extending electrically conductive pin formed from at least one preselective electrically conductive material, said pin having a preselected length and a preselected cross-sectional area with at least one fuse-like aperture disposed in said pin along the longitudinal axis of said pin a preselected distance from one extremity of said pin, said fuse-like aperture being of a preselected cross-sectional area to provide at least one area adjacent said aperture of said electrically conductive material, said adjacent area being sized to burn-off in fuse-like fashion at a preselected time, temperature and amperage density, one end of said pin being adapted to be connected to said electrical supply source and the opposite end to said electrically dependent apparatus.

26. The current conducting pin of claim 25, said fuse-like aperture in said pin being symmetrically disposed along the longitudinal axis of said pin in surrounding relation to said fuse-like aperture.

27. The current conducting pin of claim 25, said pin being of longitudinally extending cylindrical shape.

28. The current conducting pin of claim 25, said fuse-like aperture in said pin being of circular cross-section.

29. The current conducting pin of claim 25, said pin being formed from stainless steel along the outer core thereof and having an inner copper core.

30. The current conducting pin of claim 25, said pin being of longitudinally extending cylindrical shape of an approximate length of one and seven eighths (1 7/8) inches and a cross-sectional outer diameter of approximately zero point one two five (0.125) inches with said fuse-like aperture extending there through symmetrically along the longitudinal axis thereof and having a circular cross-sectional area of approximately zero point zero zero four four (0.0044) square inches.

31. The current conducting pin of claim 25, wherein said fuse-like area is capable of withstanding a heat rise below approximately three hundred (300) degrees Fahrenheit at current running amps of thirty (30).

* * * * *